US008342866B2

(12) United States Patent
Taylor et al.

(10) Patent No.: US 8,342,866 B2
(45) Date of Patent: Jan. 1, 2013

(54) CONNECTOR ASSEMBLIES HAVING MATING SIDES MOVED BY FLUIDIC COUPLING MECHANISMS

(75) Inventors: Attalee Snarr Taylor, Palmyra, PA (US); Richard Elof Hamner, Hummelstown, PA (US); Robert Neil Mulfinger, York Haven, PA (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 49 days.

(21) Appl. No.: 12/939,827

(22) Filed: Nov. 4, 2010

(65) Prior Publication Data

US 2012/0114286 A1 May 10, 2012

(51) Int. Cl.
*H01R 4/60* (2006.01)

(52) U.S. Cl. ..... 439/197; 439/248

(58) Field of Classification Search ..... 439/197, 439/199–201, 246–248
See application file for complete search history.

(56) References Cited

U.S. PATENT DOCUMENTS 3,076,166 A * 1/1963 Raddin ..... 439/197
4,286,834 A 9/1981 Goodman et al.
4,518,210 A 5/1985 Morrison
4,603,928 A 8/1986 Evans
4,626,056 A 12/1986 Andrews, Jr. et al.
4,629,270 A 12/1986 Andrew, Jr. et al.
4,840,569 A 6/1989 Cabourne
4,968,265 A * 11/1990 Fox, Jr. ..... 439/197
5,092,781 A 3/1992 Casciotti et al.
5,102,342 A 4/1992 Marian
5,171,154 A 12/1992 Casciotti et al.
5,228,862 A 7/1993 Baumberger et al.
5,228,863 A 7/1993 Campbell et al.
5,772,451 A 6/1998 Dozier, II et al.
5,906,500 A 5/1999 Kakuta et al.
6,062,872 A * 5/2000 Strange et al. ..... 439/67
6,071,137 A * 6/2000 Rutigliano ..... 439/197
6,077,090 A 6/2000 Campbell et al.
6,254,410 B1 7/2001 Sugiyama et al.
6,411,517 B1 6/2002 Babin
6,672,878 B2 1/2004 Dean
6,945,788 B2 9/2005 Trout et al.
7,044,746 B2 5/2006 Copper et al.
7,114,961 B2 10/2006 Williams
7,297,015 B1 11/2007 Desrosiers et al.
7,374,441 B2 5/2008 Rubenstein
7,419,400 B1 9/2008 Taylor et al.
7,425,134 B1 9/2008 Taylor
7,438,582 B2 10/2008 Taylor
(Continued)

OTHER PUBLICATIONS

European Search Report, European Application No. EP 11 18 7386, European Filing Date Oct. 25, 2011.
Neoconix PCBeam™ Interposer Design Guide, Neoconix, Rev. 070925, 4 pgs.

*Primary Examiner* — Felix O Figueroa

(57) ABSTRACT

A connector assembly having a connector body that includes a support structure and a mating side and has an adjustable cavity therebetween. The mating side has a mating array of terminals thereon that is configured to face a communication component. The mating side is moveable relative to the support structure. The connector assembly also includes an elastic container having a reservoir that holds a working fluid. The elastic container is positioned within the adjustable cavity between the support structure and the mating side. The elastic container changes between first and second shapes to move the mating side toward and away from the communication component.

21 Claims, 9 Drawing Sheets

U.S. PATENT DOCUMENTS

2007/0097662 A1 5/2007 Dean
2008/0227314 A1 9/2008 Taylor
2009/0246981 A1 10/2009 Shmatovich et al.

* cited by examiner

CONNECTOR ASSEMBLIES HAVING MATING SIDES MOVED BY FLUIDIC COUPLING MECHANISMS

BACKGROUND OF THE INVENTION

The subject matter herein relates generally to connector assemblies, and more particularly, to connector assemblies that are configured to communicatively couple different communication components using moveable mating sides.

Some communication systems, such as servers, routers, and data storage systems, utilize connector assemblies for transmitting signals and/or power through the system. Such systems typically include a backplane or a midplane circuit board, a motherboard, and a plurality of daughter cards. The connector assemblies include one or more connectors that attach to the circuit boards or motherboard for interconnecting the daughter cards to the circuit boards or motherboard when the daughter card is inserted into the system. Each daughter card includes a header or receptacle assembly having a mating face that is configured to connect to a mating face of the connector. The header/receptacle assembly is typically positioned on or near a leading edge of the daughter card. Prior to being mated, the mating faces of the header/receptacle assembly and the connector are aligned with each other and face each other along a mating axis. The daughter card is then moved in an insertion direction along the mating axis until the mating faces engage and mate with each other.

The conventional backplane and midplane connector assemblies provide for interconnecting the daughter cards to the backplane or midplane circuit board by moving the daughter card in an insertion direction, which is the same as the mating direction. In some cases, it may be desirable to mate the daughter card in a mating direction that is perpendicular to the insertion direction. By way of one specific example, the header/receptacle assembly may be on a surface of the daughter card and face a direction that is perpendicular to the insertion direction (e.g., perpendicular to the surface of the daughter card), and the connector may be on the backplane circuit board and also face a direction perpendicular to the insertion direction. In such a case, it may be difficult to properly align and mate the header/receptacle assembly and the connector. Other examples exist in communication systems where it may be difficult to properly align and mate two communication components that have complementary arrays of terminals.

Accordingly, there is a need for connector assemblies that facilitate interconnection of communication components (e.g., circuit boards, other connectors) when the communication components are oriented in an orthogonal relationship. Furthermore, there is a general need for various connectors capable of establishing an electrical and/or optical connection between different components.

BRIEF DESCRIPTION OF THE INVENTION

In one embodiment, a connector assembly is provided that has a connector body including a support structure and a mating side. The connector body also has an adjustable cavity between the support structure and the mating side. The mating side has a mating array of terminals thereon that is configured to face a communication component. The mating side is moveable relative to the support structure. The connector assembly also includes an elastic container having a reservoir that holds a working fluid. The elastic container is positioned within the adjustable cavity between the support structure and the mating side. The elastic container changes between first and second shapes to move the mating side toward and away from the communication component.

The mating array of terminals may include at least one of optical terminals for transmitting optical signals and electrical terminals for transmitting electrical current. Optionally, the elastic container may expand from the first shape to the second shape and contract from the second shape to the first shape. Also optionally, the connector assembly may include an operator-controlled actuator that engages the elastic container to change the elastic container from the first shape to the second shape.

In another embodiment, a connector assembly is provided that includes a connector body having a support structure and a mating side and having an adjustable cavity therebetween. The mating side has a mating array of terminals thereon that is configured to face a communication component. The mating side is moveable relative to the support structure. The connector assembly also includes an elastic container that has a container wall defining a reservoir for holding a working fluid. The container wall includes a fluidic port that permits the working fluid to flow therethrough. The elastic container expands when the working fluid flows into the reservoir and contracts when the working fluid is removed from the reservoir. The mating array of terminals moves toward the communication component when the working fluid expands the elastic container.

In another embodiment, a connector assembly is provided that has a connector body including a support structure and a mating side. The connector body also has an adjustable cavity between the support structure and the mating side. The mating side has a mating array of terminals thereon that is configured to face a communication component. The mating side is moveable relative to the support structure. The connector assembly also includes an elastic container having a reservoir that holds a working fluid. The elastic container is positioned within the adjustable cavity between the support structure and the mating side. The connector assembly also includes an operator-controlled actuator that engages the elastic container within the adjustable cavity. The actuator displaces the working fluid within the elastic container to change the elastic container from a first shape to a second shape. The elastic container moves the mating side toward the communication component when changing from the first shape to the second shape.

DETAILED DESCRIPTION OF THE INVENTION

Figure 1:
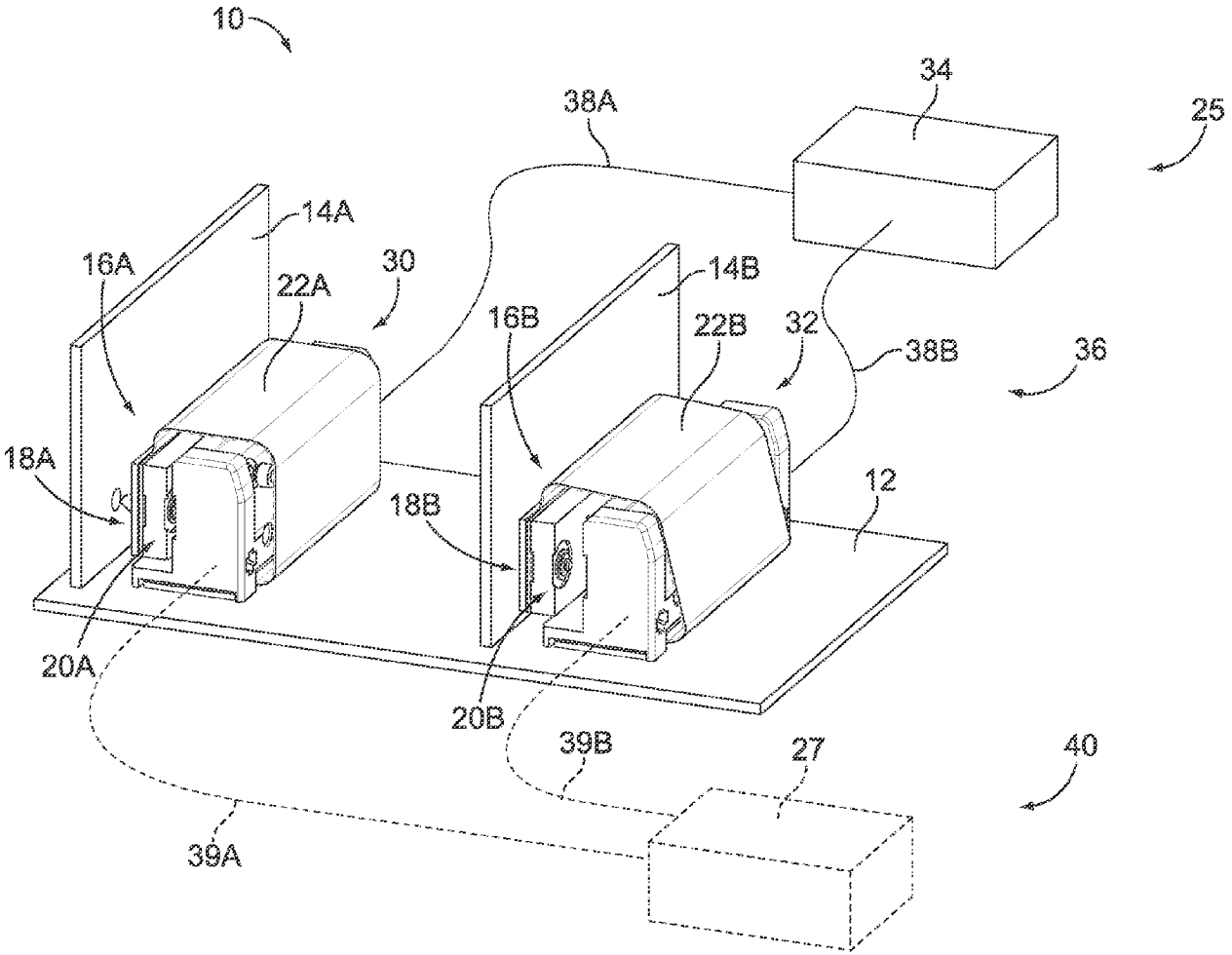
FIG. 1 is a perspective view of a communication system formed in accordance with one embodiment.

Embodiments described herein include communication systems and connector assemblies that are configured to establish at least one of an electrical or optical connection to transmit data signals between different communication components. Connector assemblies described herein may also establish an electrical connection to transmit power between the communication components. Communication components that may be interconnected by such connector assemblies include printed circuits (e.g., circuit boards or flex circuits), other connector assemblies (e.g., optical and/or electrical connector assemblies), and any other components that are capable of establishing an electrical or optical connection. The connector assemblies can include one or more moveable mating sides that include mating arrays of terminals. The mating sides may be moved using a fluidic (i.e., pneumatic or hydraulic) coupling mechanism that is driven by a working fluid. As used herein, a "working fluid" includes gases and/or liquids.

As used herein, the term "mating array" includes a plurality of terminals arranged in a predetermined configuration. The terminals may be held in a fixed relationship with respect to each other. The terminals of a mating array may be held together by a common structure or base material. By way of example, the mating array may be a contact array having a plurality of electrical terminals configured to establish an electrical connection. Mating arrays may be printed circuits (e.g., circuit boards) or interposers. The mating array may also be an optical terminal array having optical terminals configured to establish an optical connection. In some embodiments, the mating array may include both electrical terminals and optical terminals. As used herein, when two components are "communicatively coupled" or "communicatively connected," the two components can transmit electric current (e.g., for data signals or power) and/or light (e.g., optical data signals) therebetween.

A variety of electrical terminals may be used in the contact arrays, including electrical terminals that are stamped and formed, etched and formed, solder ball contacts, contact pads, and the like. In some embodiments, the electrical terminals form a planar array (i.e., the electrical terminals are arranged substantially co-planar with respect to each other and face a common direction). In other embodiments, the contact array may have multiple sub-arrays of electrical terminals that are not co-planar. The electrical terminals may be used to transmit data signals or electrical power. Optical terminal arrays may have similar configurations and features as described with respect to the contact arrays.

As used herein, the term "printed circuit," includes any electric circuit in which the conductors have been printed or otherwise deposited in predetermined patterns on an insulating base or substrate. For example, a printed circuit may be a circuit board, an interposer made with printed circuit board (PCB) material, a flexible circuit having embedded conductors, a substrate having one or more layers of flexible circuit therealong, and the like. The printed circuit may have electrical terminals arranged thereon.

A "flex connection," as used herein, includes flexible pathways that are capable of transmitting electric current and/or optical signals. The flex connection includes a flexible material (e.g., bendable or twistable). The flex connection may have, for example, a sheet-like or ribbon-like structure. The flex connection may be attached to one or more components, such as a mating array or mating side, and permit movement of the component(s). A flex connection may include at least one of an electrical conductor and a fiber optic communication line and may be used to interconnect different mating arrays. For example, a flex connection may be a flexible circuit configured to convey a current through conductors (e.g., conductive traces) embedded within a flexible substrate. Such a flexible circuit may transmit data and/or power between first and second components. Furthermore, a flex connection may include one or more fiber optic communication lines (e.g., fiber optic cables) having optical waveguides that transmit light, for example, by total internal reflection. The optical waveguides may include a flexible cladding. The fiber optic cables may be configured to have a limited bend radius so that optical waveguides may transmit light through total internal reflection. A "flexible circuit" (also called flex circuit), as used herein, is a type of flex connection that comprises a printed circuit having an arrangement of conductors embedded within or between flexible insulating material. A "fiber optic ribbon" includes a plurality of optical fibers held together by a common layer or ribbon of material. A fiber optic ribbon may include more than one layer or ribbon.

As used herein, a "fluidic coupling mechanism" uses gases and/or liquids to move a mating side that has a mating array of terminals thereon. A fluidic coupling mechanism generally includes a connector body having an adjustable cavity. The connector body may have moving parts that permit the adjustable cavity to change in size or position when a working fluid flows into or out of the cavity or is displaced within the cavity. For example, a fluidic coupling mechanism may include an elastic container located within the adjustable cavity that has a reservoir for holding the working fluid. The elastic container may be capable of changing to different shapes when the working fluid flows into or out of the elastic container. Expanding the elastic container may provide a displacement force that moves the mating side. Fluidic coupling mechanisms may also include an operator-controlled actuator that is configured to engage the elastic container. The actuator may press against the elastic container thereby displacing the working fluid in the reservoir and changing a shape of the elastic container. When the actuator is moved to engage the elastic container, the adjustable cavity may change in volume and/or position.

FIG. 1 is a front perspective view of a communication system 10 formed in accordance with one embodiment that includes first and second connector assemblies 30 and 32. The communication system 10 also includes a primary communication component 12 (e.g., motherboard) and secondary communication components 14A and 14B (e.g., daughter cards). The primary communication component 12 is communicatively coupled to the secondary communication components 14A and 14B by the first and second connector assemblies 30 and 32, respectively. The communication system 10 may be a variety of communication systems, such as a server system, router system, or data storage system. In the illustrated embodiment, the primary and secondary communication components 12, 14A, and 14B are printed circuits and, more specifically, circuit boards. However, in other embodiments, the primary and secondary communication components 12, 14A, and 14B may be other components that are capable of communicating electrical current and/or optical signals. Although the secondary communication components 14A and 14B are mounted to the same primary communication component 12 in FIG. 1, the secondary communication components 14A and 14B may be mounted to different primary communication components in other embodiments.

The first and second connector assemblies 30 and 32 include respective interconnect assemblies 16A and 16B. Each of the interconnect assemblies 16A and 16B may provide a corresponding transmission pathway between the primary communication component 12 and the respective secondary communication component 14A and 14B. As shown, the interconnect assemblies 16A and 16B include mating arrays 18A and 18B, respectively, that are configured to engage the secondary communication components 14A and 14B, respectively. The mating arrays 18A and 18B may include optical terminals and/or electrical terminals. The interconnect assemblies 16A and 16B also include flex connections 22A and 22B, respectively. The flex connections 22A and 22B communicatively couple the mating arrays 18A and 18B, respectively, to the primary communication component 12.

The connector assemblies 30 and 32 also include respective mating sides 20A and 20B. The mating sides 20A and 20B include the mating arrays 18A and 18B, respectively, which face the respective secondary communication component 14A and 14B. The flex connections 22A and 22B permit movement of the mating sides 20A and 20B, respectively. The mating sides 20A and 20B are moveable toward and away from the respective secondary communication component 14A and 14B between retracted and engaged positions so that the mating arrays 18A and 18B may engage complementary arrays of terminals (not shown) along the secondary communication components 14A and 14B, respectively. As shown in FIG. 1, the mating side 20A is spaced apart from the secondary communication component 14A in the retracted position, and the mating side 20B is communicatively coupled to the secondary communication component 14B in the engaged position.

The mating arrays 18A and 18B may be selectively held and moved by, for example, fluidic coupling mechanisms 160 (shown in FIG. 7) and 360 (shown in FIG. 13), which will be described in further detail below. When the mating arrays 18A and 18B are in the retracted positions, the secondary communication components 14A and 14B may be inserted into or removed from the communication system 10. The secondary communication components 14A and 14B may be in fixed or locked positions and substantially orthogonal to the primary communication component 12 before the mating arrays 18A and 18B are moved toward and engage the respective secondary communication components 14A and 14B. However, in other embodiments, the secondary communication components 14A and 14B may be substantially orthogonal (or perpendicular) to the primary communication component 12 (e.g., 90°+/−20°), parallel to the primary communication component 12, or may form some other angle or some other positional relationship with respect to the primary communication component 12. For example, the secondary communication components 14A and 14B may be oblique to the primary communication component 12.

The communication system 10 may also include a control system 25 for operating the connector assemblies 30 and 32. For example, the control system 25 may include a system pump or compressor 34 that is fluidicly coupled to a conduit circuit 36 that includes connector conduits 38A and 38B. The system pump 34 may selectively pump a working fluid through the connector conduits 38A and 38B. The working fluid may be a gas or liquid. The control system 25 may use the working fluid to control fluidic coupling mechanisms of the connector assemblies 30 and 32 to selectively move the mating sides 20A and 20B. The fluidic coupling mechanisms of the connector assemblies 30 and 32 may be similar to the fluidic coupling mechanism 160.

In the illustrated embodiment, the connector conduits 38A and 38B are directly connected to the system pump 34 and the connector assemblies 30 and 32, respectively. However, in other embodiments, the conduit circuit 36 may include a system of conduits that are fluidicly coupled to one another and the connector assemblies 30 and 32. The conduit circuit 36 may also include a system of valves (not shown) that are selectively actuated by the control system 25 to operate the connector assemblies 30 and 32.

In alternative embodiments, the connector assemblies 30 and 32 may be operated by a control system 40 that includes a system controller 27 that is communicatively coupled to the connector assemblies 30 and 32 through communication lines 39A and 39B, respectively. In such alternative embodiments, the connector assemblies 30 and 32 may have internal fluidic coupling mechanisms therein that are similar to the fluidic coupling mechanism 360 shown in FIG. 13. For example, the system controller 27 may selectively operate an actuator to displace the working fluid within the connector assemblies 30 and 32 thereby causing the mating sides 20A and 20B to move between the retracted and engaged positions.

Figure 2:
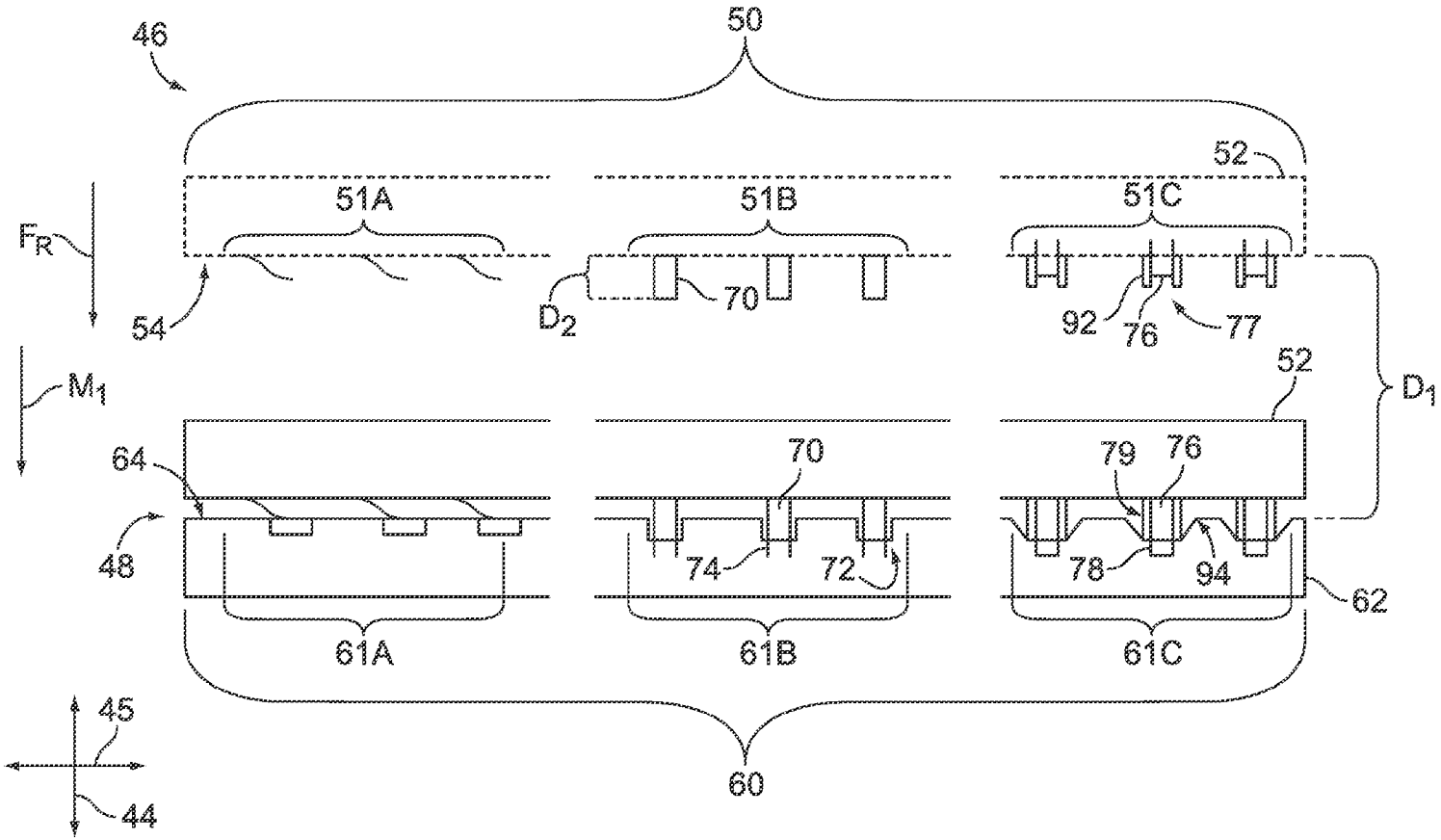
FIG. 2 illustrates top cross-sectional views of a mating array in a retracted position and in an engaged position with respect to a complementary array.

FIG. 2 is a top cross-sectional view illustrating exemplary mating and complementary arrays 50 and 60, respectively, that may be used in accordance with various embodiments. A communication component 52 may include the mating array 50 and a communication component 62 may include the complementary array 60. FIG. 2 illustrates the mating array 50 in a retracted position 46 (shown in dashed lines) and in an engaged position 48 (shown in solid lines) with respect to the complementary array 60. Although not shown, the mating array 50 may be communicatively coupled to flex connections that permit the mating array 50 to be moved bi-directionally along a mating axis 44 between the retracted and engaged positions 46 and 48. In particular embodiments, the mating array 50 may be moved along the mating axis 44 in a linear manner between the retracted position 46 and the engaged position 48. When the mating array 50 moves toward the complementary array 60 in a direction along the mating axis 44, the mating array 50 moves along a mating direction $M_1$.

By way of example, the mating array 50 of terminals may include electrical terminals 51A, optical terminals 51B, and optical terminals 51C. The complementary array 60 of terminals may include electrical terminals 61A, optical terminals 61B, and optical terminals 61C. Each terminal of the mating array 50 is configured to engage an associated terminal of the complementary array 60. Associated terminals are a pair of terminals that are configured to communicatively couple to each other when the mating and complementary arrays 50 and 60 are engaged.

As shown, the communication component 52 may have a mating or array surface 54 having the mating array 50 thereon, and the communication component 62 may have a mating or array surface 64 having the complementary array 60 of terminals thereon. In particular embodiments, the mating surfaces 54 and 64 may extend adjacent to and substantially parallel to each other in both of the retracted and engaged positions 46 and 48. For example, the mating surfaces 54 and 64 may extend in a direction along a longitudinal axis 45. The longitudinal axis 45 may be substantially orthogonal to the mating axis 44. The mating surfaces 54 and 64 may face each other when in the retracted and engaged positions 46 and 48. As will be discussed further below, the mating array 50 may be selectively held and moved by a coupling mechanism until the associated terminals are engaged. As such, the mating array 50 may be removably coupled to or engaged with the complementary array 60.

In the illustrated embodiment, the mating surface 54 and the mating surface 64 extend substantially parallel to one other while in the engaged and retracted positions 48 and 46, respectively, and in any position therebetween. The associated terminals are spaced apart from each other by substantially the same distance $D_1$ in the retracted position 46. When the mating array 50 is moved toward the second communication component 62 in a linear manner along the mating axis 44, the distance $D_1$ that separates the associated terminals decreases until the associated terminals are engaged.

The electrical terminals 51A may include resilient beams that flex to and from the mating surface 54. The resilient beams resist deflection and exert a resistance force $F_R$ in a direction away from the mating surface 54. The electrical terminals 61A are configured to engage the electrical terminals 51A. In the illustrated embodiment, the electrical terminals 61A are contact pads that are substantially flush with the mating surface 64. However, the contact pads are not required to be substantially flush with the mating surface 64. Furthermore, in alternative embodiments, the electrical terminals 51A and 61A may take on other forms including other stamped and formed contacts, etched and formed contacts, contact pads, and the like.

The optical terminals 51B include fiber ends 70 that project a distance $D_2$ beyond the mating surface 54. The fiber ends 70 may be sized and shaped relative to fiber cavities 72 of the optical terminals 61B so that the fiber ends 70 are received by the fiber cavities 72 when the mating array 50 is moved into the engaged position 48. In the engaged position 48, the fiber ends 70 are aligned with fiber ends 74 of the optical terminals 61B within the fiber cavities 72. Associated fiber ends 70 and 74 may abut each other to transfer a sufficient amount of light for transmitting optical signals. For example, associated fiber ends 70 and 74 may be configured to minimize any gaps between each other.

Also shown in FIG. 2, the optical terminals 51C include fiber ends 76 located within corresponding fiber channels 77 and alignment features 92 that surround the fiber ends 76 and define the fiber channels 77. The optical terminals 61C include fiber ends 78 and edge surfaces 94 that surround the fiber ends 78. The edge surfaces 94 define fiber cavities 79. The alignment features 92 are projections or caps that are configured to engage the edge surfaces 94. The edge surfaces 94 are shaped to engage the alignment features 92 to align the fiber ends 76 and 78. As shown in FIG. 2, the fiber ends 76 are withdrawn and held within the fiber channels 77 when the mating array 50 is in the retracted position 46. When the mating surfaces 54 and 64 are interfaced with each other in the engaged position 48, the alignment features 92 are received within associated fiber cavities 79. The fiber ends 76 may then advance through the corresponding fiber channels 77 to abut the fiber ends 78 within the fiber cavities 79.

Figure 3:
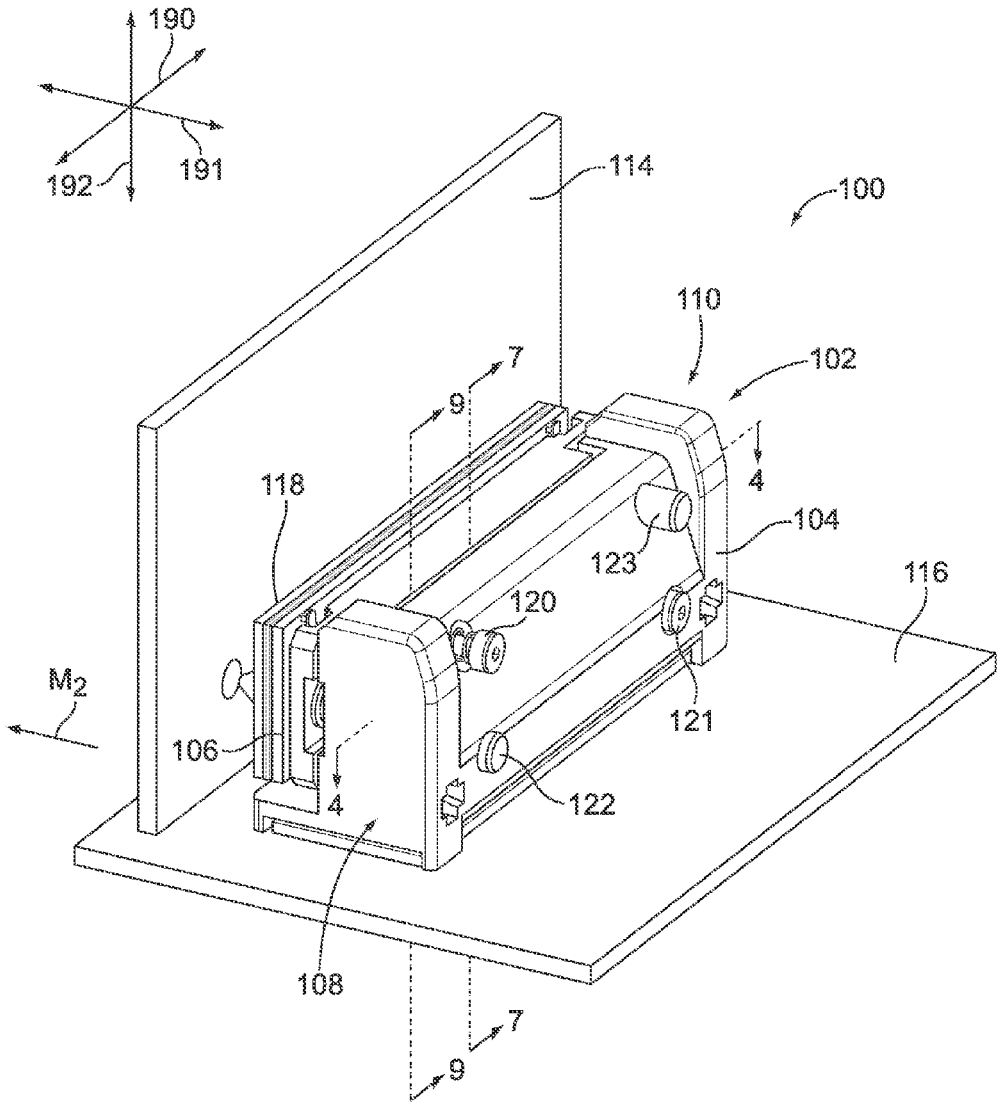
FIG. 3 is a perspective view of a connector assembly formed in accordance with one embodiment.

FIG. 3 is a perspective view of a connector assembly 100 formed in accordance with one embodiment. The connector assembly 100 may have similar features and elements as the connector assemblies 30 and 32 (FIG. 1) and may be fluidicly coupled to a control system (not shown) that is similar to the control system 25 (FIG. 1). The connector assembly 100 may be used to communicatively couple communication components 114 and 116. The connector assembly 100 is oriented with respect to mutually perpendicular axes 190-192 that include a longitudinal axis 190, a mating axis 191, and a mounting axis 192. As shown, the connector assembly 100 may include a connector housing or body 102 that includes a support structure 104 and a mating side 106 that are operatively coupled to each other. The connector assembly 100 is mounted onto the communication component 116. The connector body 102 may be elongated and extend along the longitudinal axis 190 between body ends 108 and 110. The connector assembly 100 may also include a flex connection 112 (shown in FIG. 7) that is attached to the mating side 106 and communicatively coupled to the communication component 116. The mating side 106 includes a mating array 118 of terminals 125 (FIG. 4) that faces the communication component 114 in a direction along the mating axis 191.

Figure 8:
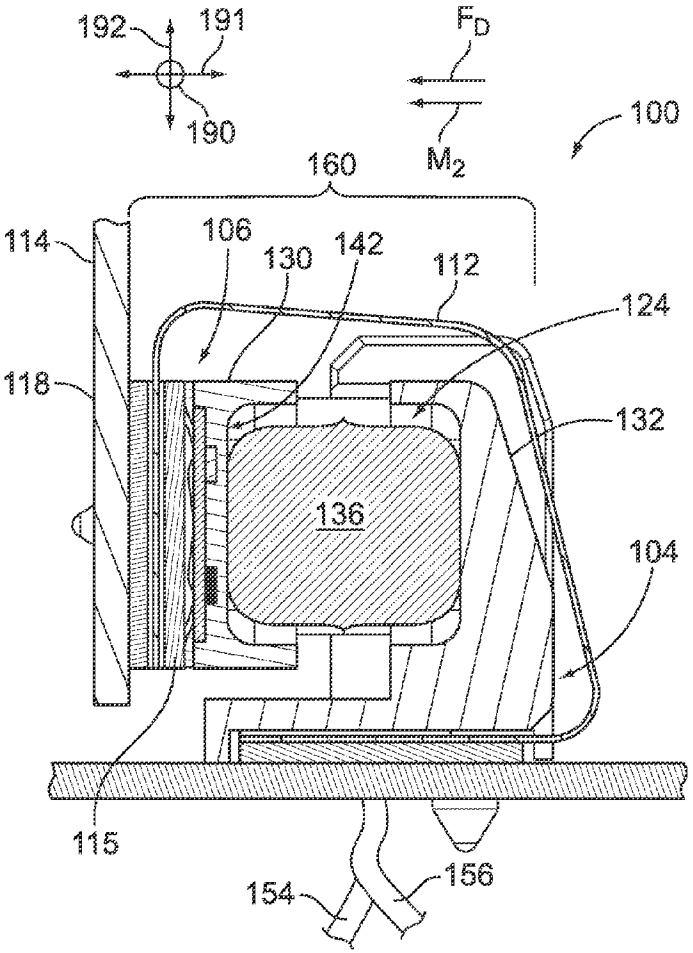
FIG. 8 is the cross-section of the connector assembly shown in FIG. 7 when the connector assembly is in an engaged position.

The mating side 106 is configured to move between the retracted position as shown in FIG. 3 and an engaged position shown in FIG. 8. The mating side 106 may move bi-directionally along the mating axis 191 that is substantially orthogonal to the longitudinal axis 190. The connector assembly 100 may also include retention elements 120 and 121 and guide elements 122 and 123 that operatively couple the support structure 104 to the mating side 106. The retention and guide elements 120-123 allow a range of movement by the mating side 106 along the mating axis 191.

Figure 4:
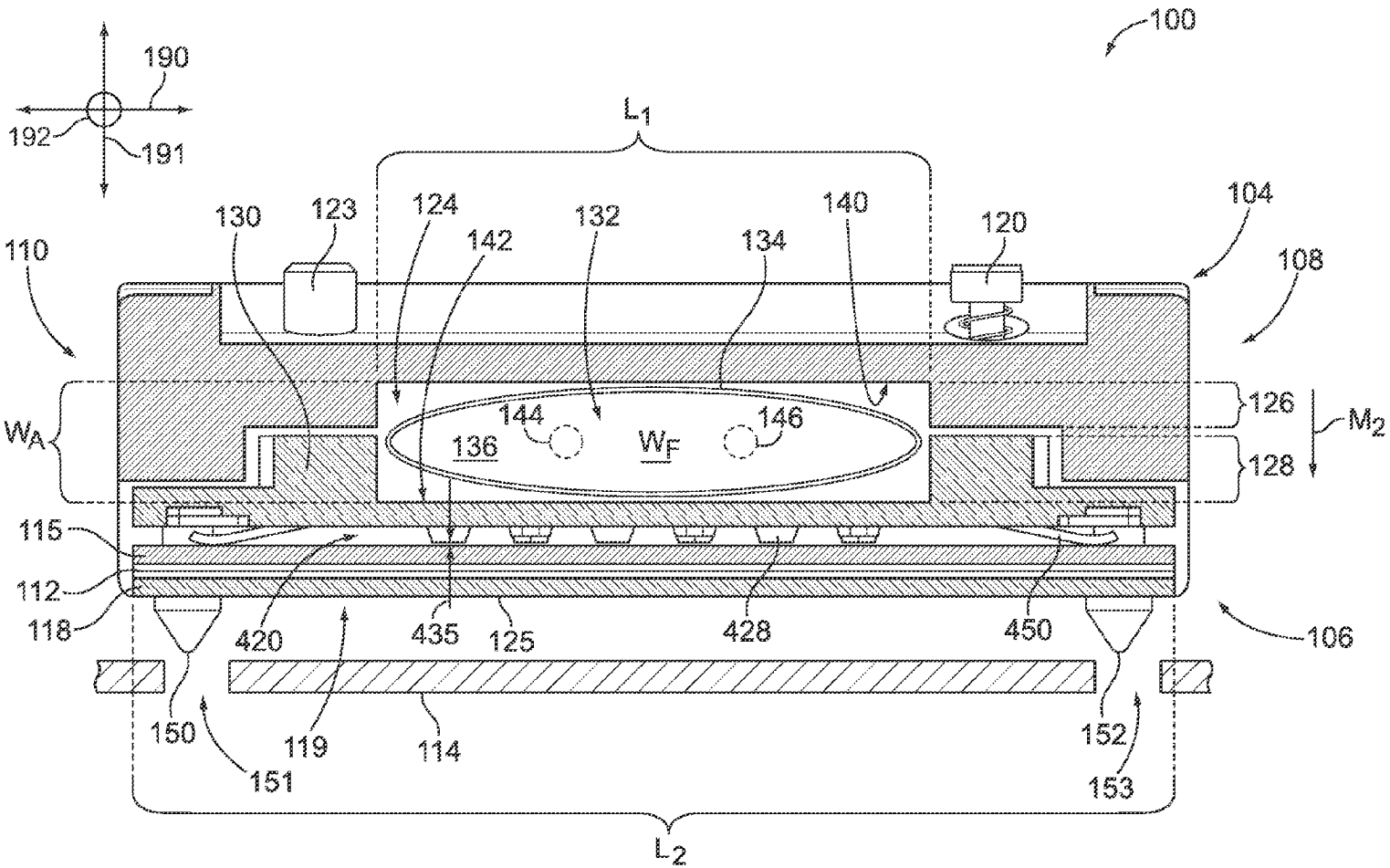
FIG. 4 is a cross-section of the connector assembly in FIG. 3 taken along the line 4-4.

FIG. 4 is a cross-section of the connector assembly 100 taken along the line 4-4 in FIG. 3 when the mating side 106 is in the retracted position. As shown, the mating side 106 includes the mating array 118, a base panel 115, and a section of the flex connection 112. The section of the flex connection 112 is secured between the base panel 115 and the mating array 118. The mating side 106 may include alignment features 150 and 152 that project away from a mating surface 119 of the mating array 118 toward the communication component 114. Optionally, the alignment features 150 and 152 may facilitate securing the mating array 118, the base panel 115, and the section of the flex connection 112 together.

In the illustrated embodiment, the mating array 118 includes an interposer having mating contacts on both sides. On one side, the mating contacts engage the flex connection 112 and, on the other side, the mating contacts constitute electrical terminals 125 of the mating array 118 that are configured to engage the communication component 114. In alternative embodiments, an interposer is not used. For example, the electrical terminals 125 of the mating array 118 may be a part of the flex connection 112. Furthermore, in other embodiments, the mating array 118 may include optical terminals.

Also shown, the mating side 106 includes a header 130 and a self-alignment sub-assembly 420 located between the base panel 115 and the header 130. The header 130 is movably coupled to the support structure 104 by the retention and guide elements 120-123 (the retention element 121 and the guide element 122 are shown in FIG. 3). The header 130 is configured to move in the mating direction $M_2$ toward the communication component 114. The self-alignment subassembly 420 may be coupled to the header 130 and provide floating and loading forces for coupling the mating array 118 to a complementary array of the communication component 114, which may be similar to the complementary array 60 shown in FIG. 2.

The connector assembly 100 also includes an adjustable cavity 124 that is located between the support structure 104 and the header 130 of the mating side 106. The adjustable cavity 124 includes a first recess portion 126 at least partially defined by an inner surface 140 of the support structure 104 and a second recess portion 128 that is at least partially defined by an inner surface 142 of the mating side 106 or, more particularly, the header 130. The inner surfaces 140 and 142 oppose each across the adjustable cavity 124 and define an adjustable dimension or width $W_A$ that extends from the inner surface 140 to the inner surface 142. The adjustable width $W_A$ is measured in a direction along the mating axis 191.

The adjustable cavity 124 also includes a length $L_1$ that is measured in a direction along the longitudinal axis 190. In the illustrated embodiment, the length $L_1$ is static or unchanging when the mating side 106 is moved between the retracted and engaged positions. The length $L_1$ extends substantially along a length $L_2$ of the mating side 106. The length $L_1$ is approximately equal to one-half the length $L_2$. However, in other embodiments, the length $L_1$ may have various dimensions, such as being substantially equal to the length $L_2$ of the mating side 106 or less than one-half the length $L_2$. Also shown in FIG. 4, the length $L_1$ is approximately centered with respect to the length $L_2$ along the longitudinal axis 190. More specifically, the adjustable cavity 124 is approximately centered between body ends 108 and 110.

The connector assembly 100 also includes an elastic container 132 that is positioned within the adjustable cavity 124. The elastic container 132 includes a container wall 134 comprising an elastic material and a reservoir 136 that is defined by the container wall 134. The reservoir 136 is configured to hold a working fluid $W_F$ during operation of the connector assembly 100. The elastic material may comprise any material (e.g., rubber) that allows the elastic container to change between different shapes as described herein. More specifically, the container wall 134 may comprise an elastic material that is configured to substantially return the elastic container 132 to a first or contracted shape when additional forces are not applied to the elastic container 132.

In some embodiments, the container wall 134 includes fluidic ports 144 and 146 (indicated by circular dashed lines) that provide fluidic access to the reservoir 136 for the working fluid $W_F$ to flow therethrough. The fluidic ports 144 and 146 may be coupled to connector conduits 154 and 156 (shown in FIG. 7). Each fluidic port 144 and 146 may function as an inlet port that allows the working fluid $W_F$ to flow into the reservoir 136 and/or an outlet port that allows the working fluid $W_F$ to be removed from the reservoir 136. In the illustrated embodiment, each of the fluidic ports 144 and 146 permits the working fluid $W_F$ to flow into and out of the reservoir 136. As shown, the elastic container 132 includes only two fluidic ports 144 and 146 that are located proximate to a bottom of the connector body 102. However, in other embodiments, the elastic container 132 may have only one fluidic port or more than two fluidic ports. The fluidic ports may also have other locations.

Figure 5:
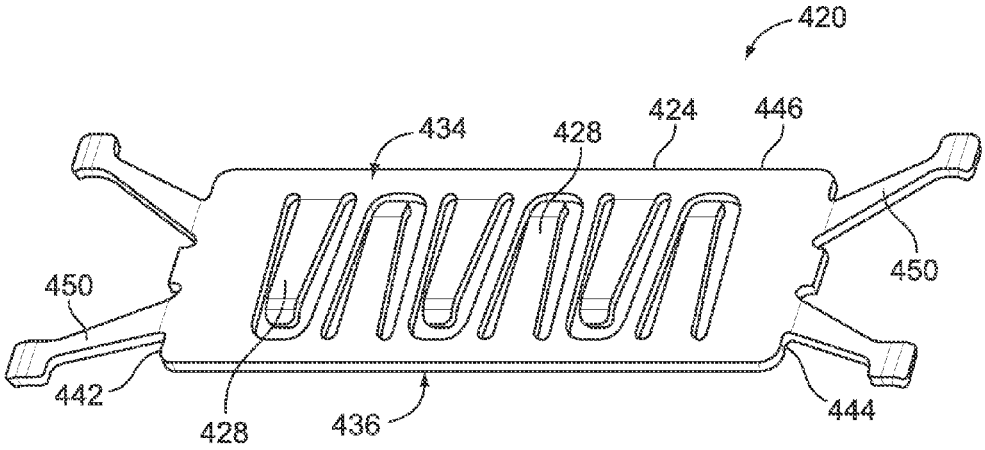
FIG. 5 is perspective view of a self-alignment subassembly that may be used with the connector assembly shown in FIG. 3.
Figure 6:
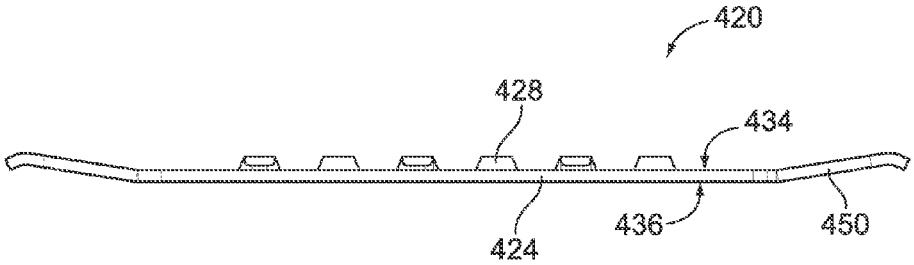
FIG. 6 is a side view of the self-alignment subassembly shown in FIG. 5.

FIGS. 5 and 6 are a perspective view and a side view, respectively, of the self-alignment subassembly 420. The self-alignment subassembly 420 is illustrated as a spring plate that has a generally planar body 424 that extends between opposite sides 434 and 436. As shown in FIG. 5, the sides 434 and 436 are interconnected by opposite edges 442 and 444 and opposite edges 446 and 448. As shown in FIGS. 5 and 6, the plate body 424 includes internal loading resilient members 428 that project from the side 434. Alternatively, the loading resilient members 428 may project from side 436 or from both sides 434 and 436 of the body 424. The body 424 also includes external floating resilient members 450 that project from the edges 442 and 444. The loading and floating resilient members 428 and 450 may be cantilevered beams. In one embodiment, the floating resilient members 450 may protrude further from the side 434 of the body 424 in a direction that is perpendicular to the side 434 than the loading resilient members 428. In the illustrated embodiment, the self-alignment subassembly 420 has a unitary body. For example, the self-alignment subassembly 420 may be stamped and formed from a common sheet of material, such as a metal sheet. However, in other embodiments, the self-alignment subassembly 420 may be separately formed from multiple components that are later combined.

Returning to FIG. 4, the floating resilient members 450 are configured to engage the base panel 115 and permit the mating array 118 to float or move relative to the support structure 104 and the header 130 in directions along the mating axis 191 and the mounting axis 192 in order to align the electrical terminals 125. When the alignment features 150 and 152 engage alignment openings 151 and 153 in a misaligned manner, the mating array 118 may slide along floating resilient members 450 to self-align with respect to the communication component 114. As shown, when the mating array 118 is in the retracted position, a gap 435 may exist between the loading resilient members 428 and the base panel 115. In alternative embodiments, the loading resilient members 428 may abut the base panel 115 such that no gap 435 exists.

Figure 7:
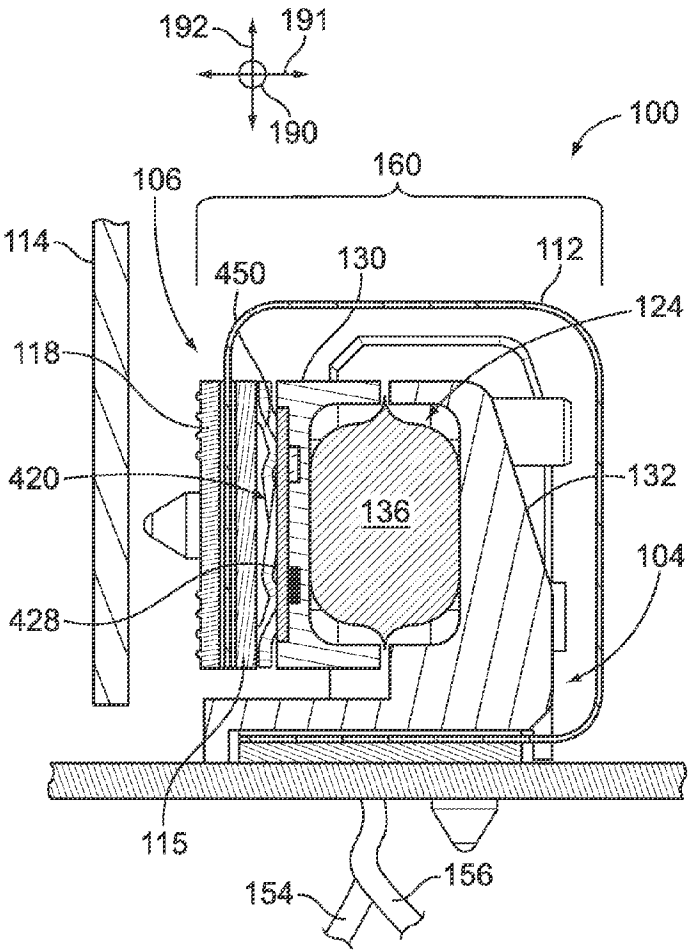
FIG. 7 is a cross-section of the connector assembly in FIG. 3 taken along the line 7-7 when the connector assembly is in the retracted position.

FIGS. 7 and 8 are cross-sections of the connector assembly 100 in the retracted and engaged positions, respectively, that illustrate the fluidic coupling mechanism 160 in greater detail. The fluidic coupling mechanism 160 includes the mating side 106, the support structure 104, and the elastic container 132 located therebetween in the adjustable cavity 124. The fluidic coupling mechanism 160 may also include the connector conduits 154 and 156. In the illustrated embodiment, the fluidic coupling mechanism 160 is configured to selectively move the mating side 106 in a linear manner along the mating axis 191 between the retracted and engaged positions. The elastic container 132 may have a first or contracted shape as shown in FIG. 7 when the mating array 118 is in the retracted position and a second or expanded shape as shown in FIG. 8 when the mating array 118 is in the engaged position.

To move the mating side 106 to the engaged position, the working fluid $W_F$ (FIG. 4) is delivered through the connector conduits 154 and 156 into the reservoir 136 to change the elastic container 132 into the expanded shape. The expanded shape has a greater volume than the contracted shape. As the elastic container 132 changes into the expanded shape, the elastic container 132 may press against the inner surface 142 (FIG. 8) of the header 130. The elastic container 132 may provide a displacement force $F_D$ (FIG. 8) that drives the header 130 toward the communication component 114. As shown in FIG. 7, the floating and loading resilient members 450 and 428 of the self-alignment subassembly 420 are configured to be compressed between the base panel 115 and the header 130. The compressed floating and loading resilient members 450 and 428 provide separate forces in the mating direction $M_2$ (FIG. 8).

The self-alignment subassembly 420 may permit the mating array 118 to float or move in one or more of the directions along the axes 190-192 relative to the support structure 104 when the mating array 118 is not properly aligned with the communication component 114. The floating resilient members 450 of the self-alignment subassembly 420 engage the base panel 115 and permit the mating array 118 to float or move in at least one direction that is perpendicular to the mating direction $M_2$. As the header 130 continues to move in the mating direction $M_2$ toward the communication component 114, the resilient members 450 continue to be compressed until the loading resilient members 428 also engage the base panel 115. Continued movement of the header 130 in the mating direction $M_2$ toward the communication component 114 causes the loading resilient members 428 to be compressed between the header 130 and the base panel 115. Compression of the loading resilient members 428 causes the loading resilient members 428 to impart a loading force on the mating array 118 in the mating direction $M_2$.

To return the mating array 118 to the retracted position, the working fluid $W_F$ may be removed from the reservoir 136 through the connector conduits 154 and 156. In some embodiments, the loading and floating resilient members 428 and 450 may provide a restoring force in a direction that is opposite to the displacement force $F_D$ to facilitate removing the working fluid $W_F$. For example, when the working fluid $W_F$ is permitted to be removed from the reservoir 136, potential energy stored within the loading and floating resilient members 428 and 450 may provide the restoring force to initially move the header 130 toward the support structure 104. Accordingly, the fluidic coupling mechanism 160 may selectively move the mating array 118 between the retracted and engaged positions.

Figure 10:
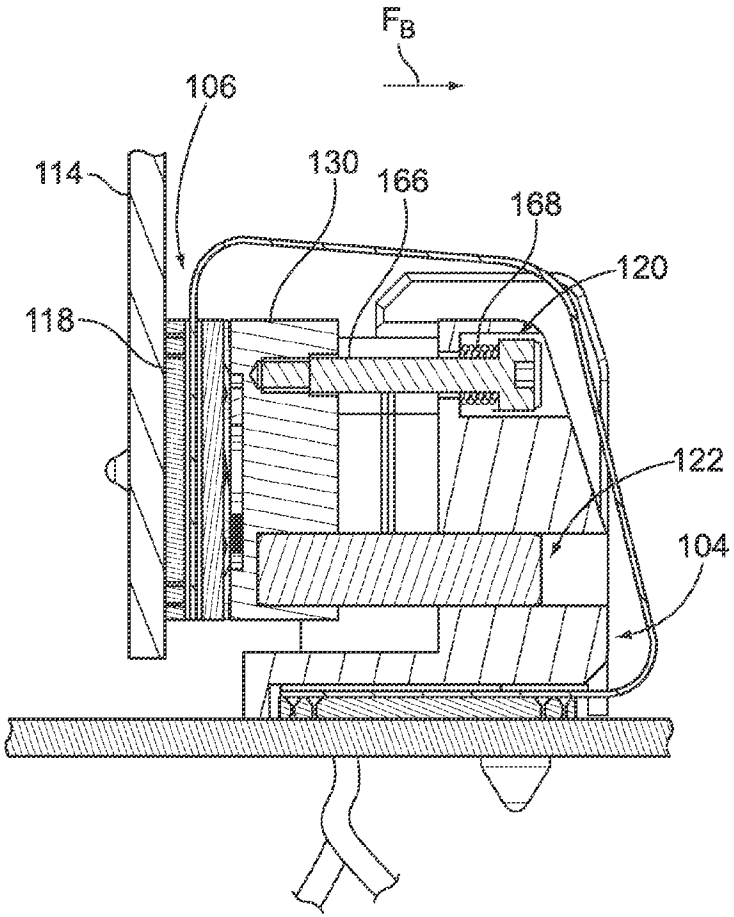
FIG. 10 is the cross-section of the connector assembly shown in FIG. 9 when the connector assembly is in an engaged position.
Figure 9:
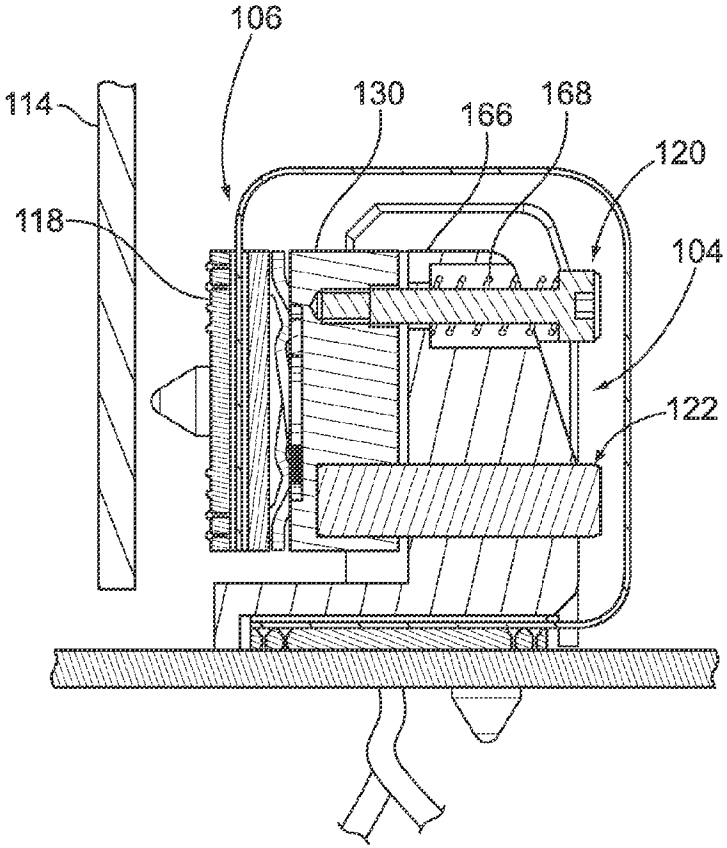
FIG. 9 is a cross-section of the connector assembly in FIG. 3 taken along the line 9-9 when the connector assembly is in the retracted position.

FIGS. 9 and 10 are cross-sections of the connector assembly 100 in the retracted and engaged positions, respectively, that illustrate the retention and guide elements 120 and 122 in greater detail. Although the following is with specific reference to the retention and guide elements 120 and 122, the description may be similarly applied to the retention and guide elements 121 and 123 (FIG. 3). The retention and guide elements 120-123 may operatively couple the mating side 106 and the support structure 104. As shown, the retention element 120 includes a fastener 166 (e.g., shoulder screw) and a spring member 168 (e.g., coil spring). The fastener 166 is secured to the header 130 of the mating side 106 and also to the support structure 104. When the mating side 106 is in the engaged position as shown in FIG. 10, the spring member 168 provides a biasing force $F_B$ in a direction away from the communication component 114. If the displacement force $F_D$ (FIG. 8) exceeds the biasing force $F_B$, the mating array 118 will remain engaged to the communication component 114. However, as the elastic container 132 (FIG. 4) is contracted the displacement force $F_D$ decreases. When the biasing force $F_B$ is greater than the displacement force $F_D$, the mating side 106 is moved away from the communication component 114 toward the support structure 104 thereby disengaging the mating array 118 and the communication component 114. In some embodiments, the biasing force $F_B$ may facilitate returning the elastic container 132 to the contracted state.

During movement of the mating side 106 between the engaged and retracted positions, the guide element 122 may direct the mating side 106 in a linear manner. The retention and guide elements 120-123 may limit a range of movement of the mating side 106 relative to the support structure 104. As shown in FIG. 10, the retention and guide elements 120-123 may be configured to substantially support a weight of the mating side 106.

Figure 11:
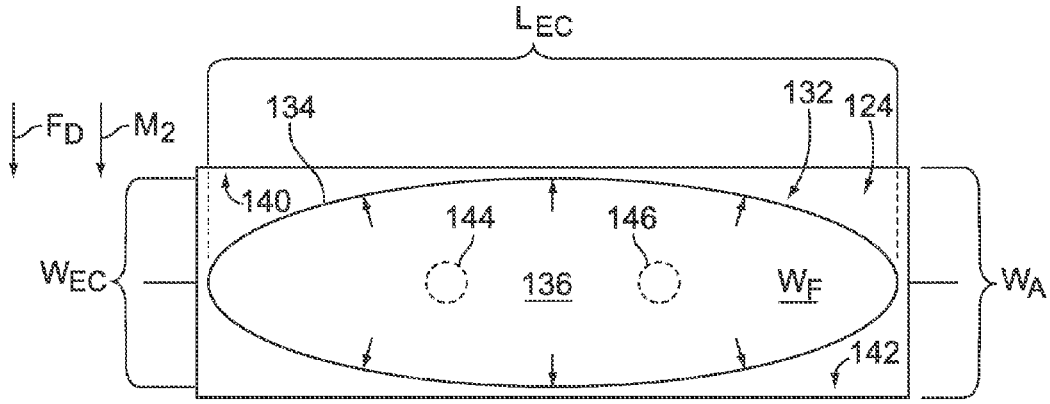
FIG. 11 is an enlarged view of an adjustable cavity having an elastic container therein that may be used with the connector assembly of FIG. 3.
Figure 12:
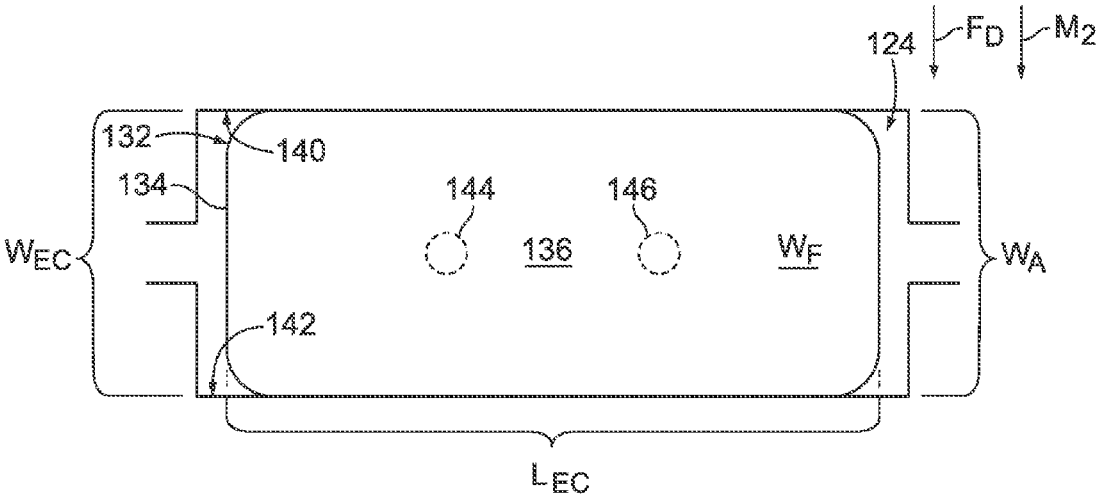
FIG. 12 is a view of FIG. 11 illustrating the elastic container in an expanded shape.

FIGS. 11 and 12 show enlarged cross-sections of the adjustable cavity 124 and the elastic container 132 when the elastic container 132 is in the contracted and expanded shapes, respectively. As the working fluid $W_F$ flows into the reservoir 136 through the fluidic ports 144 and 146, the working fluid $W_F$ expands the container wall 134 within the adjustable cavity 124 as indicated by the arrows in FIG. 11 thereby increasing a total volume of the reservoir 136. The elastic container 132 may be configured to have predetermined dimensions and shapes in the contracted state so that when the working fluid $W_F$ causes the container wall 134 to expand, the expansion occurs in a predetermined manner. For example, as shown in FIG. 11, the elastic container 132 is elongated in a direction along the longitudinal axis 190 (FIG. 3). The container wall 134 may also have different dimensions or properties (e.g., thickness or elasticity) at certain portions of the container wall 134 so that the expansion occurs in a predetermined manner. For instance, as shown in FIGS. 11-12, the elastic container 132 increases more along a width $W_{EC}$ than along a length $L_{EC}$.

When the elastic container 132 expands, the container wall 134 may interface with and press against the inner surfaces 140 and 142 of the support structure 104 and the mating side 106 (FIG. 3), respectively. The support structure 104 may be mounted or attached to another structure (e.g., the communication component 116 shown in FIG. 3) such that the support structure 104 is stationary. However, the mating side 106 is configured to move in the mating direction $M_2$ when the displacement force $F_D$ exceeds a sum of other forces (e.g., frictional forces, the biasing force $F_B$ (FIG. 10)) that hold the mating side 106 in the retracted position. In some embodiments, as the mating side 106 moves in the mating direction $M_2$, the inner surfaces 140 and 142 further separate and the adjustable width $W_A$ of the adjustable cavity 124 increases.

Figure 13:
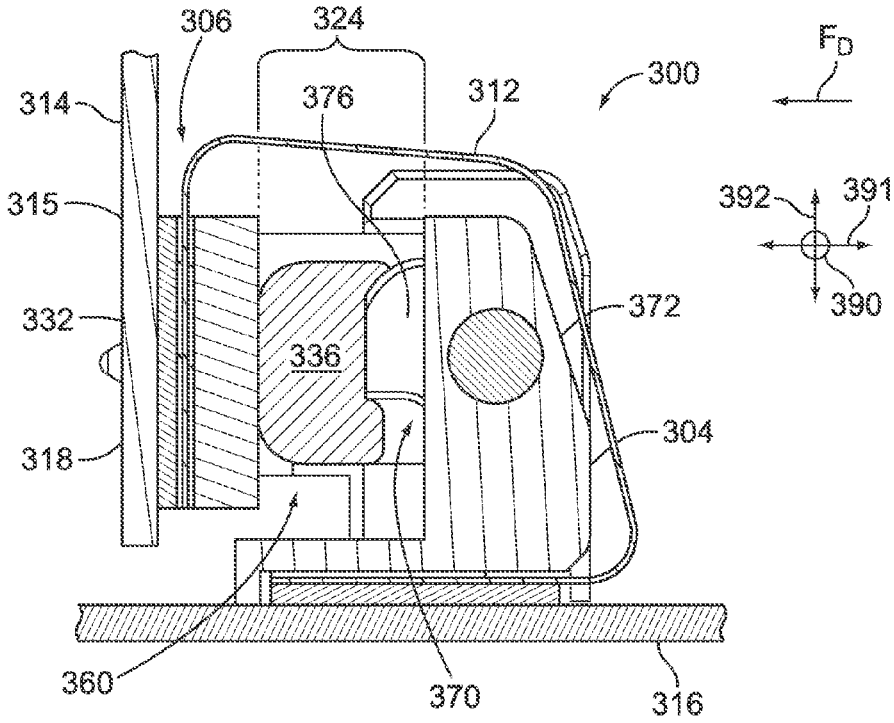
FIG. 13 is a cross-section of a connector assembly formed in accordance with another embodiment in an engaged position.

FIG. 13 is a cross-section of a connector assembly 300 formed in accordance with another embodiment. The connector assembly 300 is in an engaged position with respect to a communication component 314 and is mounted onto a communication component 316. The connector assembly 300 is oriented with respect to a longitudinal axis 390, a mating axis 391, and a mounting axis 392 and may have similar features and operate in a similar manner as the connector assembly 100 (FIG. 3). As shown, the connector assembly 300 includes a mating side 306, a support structure 304, and an adjustable cavity 324 located therebetween that includes an elastic container 332. The mating side 306 has a mating array 318, a section of a flex connection 312, and a base panel 315. Unlike the mating side 106 (FIG. 4), the mating side 306 does not have a self-alignment subassembly. Instead, the connector assembly 300 may use elastic properties of the elastic container 332 to align the terminals (not shown) of the mating array 318 and the communication component 314.

Figure 14:
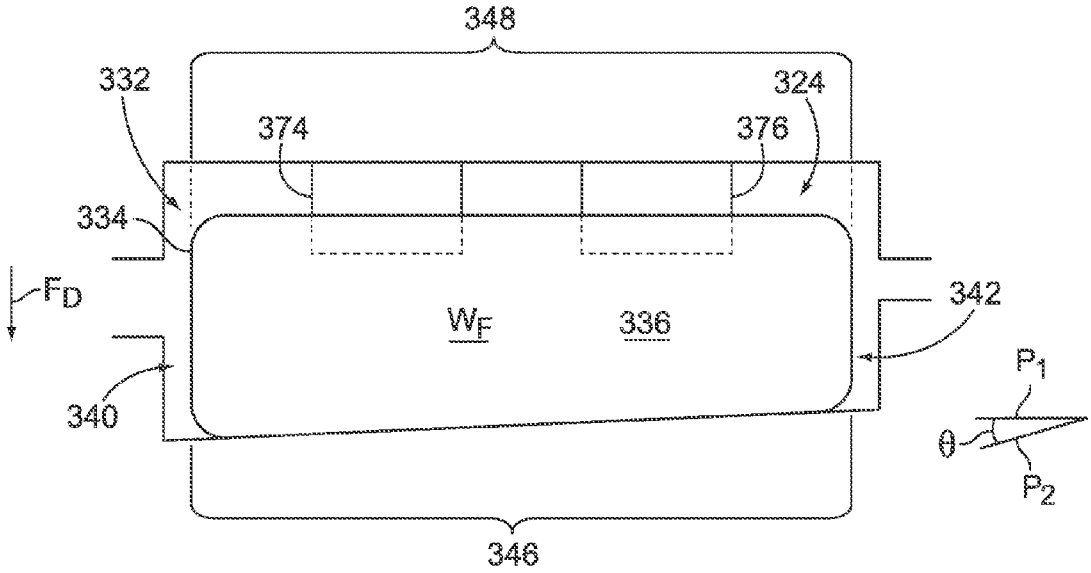
FIG. 14 is an enlarged view of an adjustable cavity having an elastic container therein that may be used with the connector assembly of FIG. 13.

The connector assembly 300 may include a fluidic coupling mechanism 360 that includes the elastic container 332 and an operator-controlled actuator 370 that is configured to engage the elastic container 332. The actuator 370 includes a rotatable axle 372 and cam members 374 (FIG. 14) and 376 that are attached to the axle 372. The cam members 374 and 376 project away from an axis of rotation of the axle 372. The axle 372 extends in a direction along the longitudinal axis 390. As shown in FIG. 14, the axle 372 (FIG. 13) has been rotated so that the cam members 374 and 376 engage the elastic container 332.

Similar to the connector assembly 100, the connector assembly 300 is configured to move the mating side 306 between retracted and engaged positions. When the mating array 318 is in the retracted position, the mating array 318 may be spaced apart from a complementary array (not shown) on the communication component 314. The elastic container 332 may be in a first shape (not shown) when the mating array 318 is in the retracted position. In the illustrated embodiment, when the axle 372 is rotated so that the cam members 374 and 376 engage the elastic container 332, the working fluid $W_F$ (FIG. 14) is displaced within the elastic container 332 such that the elastic container 332 changes from the first shape to a second shape. The second shape is shown in FIGS. 13 and 14. The elastic container 332 provides a displacement force $F_D$ against the mating side 306 when changing to the second shape that drives the mating side 306 toward the communication component 314. In the illustrated embodiment, the elastic container 332 may have a common (i.e., the same) volume of working fluid $W_F$ within the reservoir 336 for both of the first and second shapes.

FIG. 14 is an enlarged view of the adjustable cavity 324 having the elastic container 332 therein when the mating array 318 (FIG. 13) engages the communication component 314 (FIG. 13) in a misaligned manner. In some embodiments, the elastic container 332 may permit the mating array 318 to float with respect to the support structure 304 (FIG. 13) when the mating array 318 engages the communication component 314 in the misaligned manner. As such, the elastic container 332 may permit minor adjustments in an orientation of the mating array 318 to align the mating array 318 and the communication component 314.

By way of example only, the mating array 318 and the communication component 314 may be misaligned before engagement and extend along planes P1 and P2, respectively, that form an angle θ with respect to each other. As shown, the elastic container 332 includes a container wall 334 that has a mating wall portion 346, an engagement wall portion 348, and first and second side wall portions 340 and 342 that extend between the mating and engagement wall portions 346 and 348 along the mating axis 391 (FIG. 13). The mating wall portion 346 interfaces with the mating side 306. The engagement wall portion 348 is configured to engage the actuator 370 (FIG. 13). In particular embodiments, the mating and engagement wall portions 346 and 348 are located on opposite sides with respect to the mating axis 391. The actuator 370 is configured to press the engagement wall portion 348 in a direction along the mating axis 391.

The cam members 374 and 376 press into the elastic container 332 thereby displacing the working fluid $W_F$ in the reservoir 336 and changing the elastic container 332 into the second shape. When the mating array 318 and the communication component 314 engage each other in the misaligned manner, elements of the mating array 318 may engage the communication component 314 before other elements of the mating array 318. For example, an alignment feature (not shown) at one end of the mating array 318 may engage the communication component 314 before an alignment feature (not shown) at the other end of the mating array 318.

In such cases, elastic properties of the elastic container 332 may permit the mating array 318 to adjust in orientation with respect to the support structure 304 to align the mating array 318 and the communication component 314. Portions of the container wall 334 of the elastic container 332 may be distended differently than other portions. For example, the first and second side wall portions 340 and 342 may have different first and second distension states, respectively. The container wall 334 along the first side wall portion 340 is stretched more than the container wall 334 along the second side wall portion 342.

Thus, the elastic container 332 may permit the mating array 318 to move when the mating array 318 and the communication component 314 engage each other. For example, the elastic container 332 may permit the mating array 318 to rotate about the mounting axis 392 (FIG. 13), shift in a direction along a longitudinal axis 390 (FIG. 13), or shift in a direction along the mating axis 391 (FIG. 13) as the mating array 318 engages the communication component 314. Although not shown, the elastic container 332 may also permit the mating array 318 to slide with respect to the elastic container 332 so that the mating array 318 may shift longitudinally to align with the communication component 314.

In addition, when the mating array 318 is in the engaged position, the displacement force $F_D$ provided by the elastic container 332 may be distributed substantially equally along the mating side 306. Accordingly, the connector assembly 300 may reduce a likelihood of elements of the mating array 318 and communication component 314, such as electrical terminals, being damaged due to unequal application of mating forces.

It is to be understood that the above description is intended to be illustrative, and not restrictive. As such, other connectors and coupling mechanisms may be made as described herein that removably couple a moveable mating array to a complementary array. For example, a fluidic coupling mechanism may include an operator-controlled actuator that is slidable along a longitudinal axis. The actuator may have ramps that engage other mechanical components within the connector assembly. When the ramps push the mechanical components outward, the mechanical components may engage an elastic container within an adjustable cavity as described above. In addition to the above, fluidic coupling mechanisms may include other components to engage the elastic container, such as cams, roll bars, panels or walls, springs, and the like. For example, the actuator may include a wall structure that moves into and out of the adjustable cavity in plunger-like manner.

In addition, the above-described embodiments (and/or aspects thereof) may be used in combination with each other. Furthermore, many modifications may be made to adapt a particular situation or material to the teachings of the invention without departing from its scope. For example, the connector assembly 100 may not include the self-alignment subassembly 420, but may operate in a similar manner like the connector assembly 300 described with respect to FIGS. 13 and 14. Furthermore, the connect assembly 100 may also include a fluidic coupling mechanism that is similar to the fluidic coupling mechanism 360. Furthermore, the connector assembly 300 may, alternatively, use the fluidic coupling mechanism 160 in which the working fluid is delivered to the elastic container from an external source.

Although not shown, in some embodiments, the connector assemblies include one or more signal converters that convert data signals in one transmitting form to data signals in another transmitting form. The signal converters may convert electrical signals into or from optical signals. For example, a signal converter may include a modulator that encodes electrical signals and drives a light source (e.g., light-emitting diode) for creating optical signals. A signal converter may also include a detector that detects optical signals and converts the optical signals into electrical signals.

Furthermore, in some embodiments, the connector assemblies may have multiple mating sides with multiple elastic containers. The mating sides may be configured to selectively move in opposite directions simultaneously or according to a predetermined sequence. Furthermore, as described with respect to other connector assemblies, the conversion of the data signals from one form to another may occur within the corresponding connector assembly or within an optical connector that is configured to communicatively engage the mating array of the connector assembly.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a connector body comprising a support structure and a mating side, the connector body having an adjustable cavity between the support structure and the mating side, the mating side having a mating array that includes terminals and a rigid board that holds the terminals along a mating surface of the rigid board, the mating surface configured to face a communication component, wherein the mating side also includes a self-alignment subassembly that is positioned between the elastic container and the rigid board, the mating side being moveable relative to the support structure; and an elastic container having a reservoir that holds a working fluid, the elastic container being positioned within the adjustable cavity between the support structure and the mating side, the elastic container changing between first and second shapes to move the mating side, including the rigid board, toward and away from the communication component, wherein the self-alignment subassembly permits the rigid board to float relative to the elastic container as the mating array moves to engage the communication component.

2. The connector assembly in accordance with claim 1, wherein the mating array is spaced apart from the communication component when the elastic container is in the first shape and wherein the mating array is engaged to the communication component when the elastic container is in the second shape, the elastic container providing a displacement force that drives the mating side, including the rigid board, toward the communication component when the elastic container changes to the second shape.

3. The connector assembly in accordance with claim 1, wherein the elastic container comprises a fluidic port that is in fluid communication with the reservoir, the working fluid flowing through the fluidic port when the elastic container changes between the first and the second shapes.

4. The connector assembly in accordance with claim 1 further comprising an operator-controlled actuator that engages the elastic container within the adjustable cavity, the actuator displacing the working fluid within the elastic container to change the elastic container from the first shape to the second shape, the elastic container having a common volume of working fluid within the reservoir for the first and second shapes.

5. The connector assembly in accordance with claim 1 further comprising a retention element that is attached to the mating side and the support structure, the retention element flexing to a biased condition as the elastic container changes to the second shape and returning to a relaxed condition as the elastic container changes to the first shape, wherein the retention element pulls the mating array away from the communication component as the elastic container changes to the first shape.

6. The connector assembly in accordance with claim 1, wherein the rigid board moves along a mating axis toward and away from the communication component, the self-alignment subassembly permitting the rigid board to float in a plurality of directions that are perpendicular to the mating axis.

7. The connector assembly in accordance with claim 1 further comprising a flex connection that is communicatively coupled to the mating array and moves with the mating side when the mating side is moved by the elastic container; the rigid board being directly coupled to a section of the flex connection.

8. The connector assembly in accordance with claim 1, wherein the mating array comprises at least one of optical fiber ends for transmitting optical signals or electrical contacts for transmitting electrical current.

9. The connector assembly of claim 1, wherein the mating array comprises a circuit board that includes the rigid board and the terminals, the terminals being electrical contacts that comprise resilient beams.

10. The connector assembly of claim 1, wherein the mating surface of the rigid board interfaces with the communication component when the terminals are communicatively engaged to the communication component.

11. The connector assembly of claim 1, wherein the self-alignment subassembly includes a plate and a resilient member that extends from the plate, the resilient member engaging the rigid board and being in a compressed condition when the mating array is engaged to the communication component.

12. The connector assembly of claim 1, wherein the self-alignment subassembly is carried with the mating array and the rigid board when the elastic container changes between the first and second shapes.

13. A connector assembly comprising:

a connector body comprising a support structure and a mating side, the connector body having an adjustable cavity between the support structure and the mating side, the mating side having a mating array that includes terminals and a header that holds the mating array, the header being movably coupled to the support structure, the terminals configured to engage the communication component;

an elastic container having a container wall that defines a reservoir for holding a working fluid, the container wall including a fluidic port that permits the working fluid to flow therethrough, wherein the elastic container expands when the working fluid flows into the reservoir and contracts when the working fluid is removed from the reservoir, the elastic container engaging the header when expanding to move the header and the mating array toward the communication component; and a retention element that is attached to the mating side and the support structure, the retention element flexing to a biased condition as the elastic container expands and returning to a relaxed condition as the elastic container contracts, wherein the retention element pulls the mating array away from the communication component as the elastic container contracts.

14. The connector assembly of claim 13, wherein the retention element includes a spring member that that flexes between the biased and relaxed conditions.

15. The connector assembly of claim 13, further comprising a guide element that is attached to the header and slidably engaged to the support structure, the guide element and the support structure directing the header to move in a predetermined manner when the elastic container changes shape.

16. The connector assembly in accordance with claim 13, wherein the adjustable cavity changes in volume when the elastic container expands and contracts therein.

17. The connector assembly in accordance with claim 13 further comprising a flex connection that is communicatively coupled to the mating array and moves with the mating side when the mating side is moved by the elastic container, wherein a section of the flex connection is coupled to the mating array and located between the communication component and the header.

18. A connector assembly comprising:

a connector body comprising a support structure and a mating side, the connector body having an adjustable cavity between the support structure and the mating side, the mating side having a mating array that includes terminals and a header that holds the mating array, the header being movably coupled to the support structure, the terminals configured to engage the communication component;

an elastic container having a reservoir that holds a working fluid, the elastic container being positioned within the adjustable cavity between the support structure and the mating side;

an operator-controlled actuator that engages the elastic container within the adjustable cavity, the actuator displacing the working fluid within the elastic container to change the elastic container from a first shape to a second shape, the elastic container engaging the header to move the header and the mating side toward the communication component when the elastic container changes from the first shape to the second shape; and a retention element that is attached to the mating side and the support structure, the retention element flexing to a biased condition as the elastic container changes to the second shape and returning to a relaxed condition as the elastic container changes to the first shape, wherein the retention element pulls the mating array away from the communication component as the elastic container changes to the first shape.

19. The connector assembly in accordance with claim 18, wherein the actuator includes a rotatable axle and a cam member attached thereto, wherein the cam member engages the elastic container to displace the working fluid therein when the axle is rotated.

20. The connector assembly in accordance with claim 18, wherein the elastic container has a common volume of working fluid within the reservoir for the first and second shapes.

21. The connector assembly in accordance with claim 18 further comprising a flex connection that is communicatively coupled to the mating array and moves with the mating side when the mating side is moved by the elastic container, wherein a section of the flex connection is coupled to the mating array and located between the communication component and the header.

* * * * *